US006511140B2

(12) United States Patent
Corona

(10) Patent No.: US 6,511,140 B2
(45) Date of Patent: Jan. 28, 2003

(54) PULL-OUT DEVICE FOR A TALL CUPBOARD DRAWER

(75) Inventor: Stefan Corona, Dornbirn (AT)

(73) Assignee: Fulterer Gesellschaft m.b.H., Lustenau (AT)

( * ) Notice: Subject to any disclaimer, the term of this patent is extended or adjusted under 35 U.S.C. 154(b) by 0 days.

(21) Appl. No.: 09/866,149

(22) Filed: May 25, 2001

(65) Prior Publication Data

US 2002/0005687 A1 Jan. 17, 2002

(30) Foreign Application Priority Data

Jun. 6, 2000 (AT) ..... 986/2000

(51) Int. Cl.[7] ..... A47B 88/00
(52) U.S. Cl. ..... 312/334.33; 312/334.29
(58) Field of Search ..... 312/334.24, 334.25, 312/334.27, 334.29, 334.33, 334.32, 334.34, 334.39, 334.41; 384/19–23

(56) References Cited

U.S. PATENT DOCUMENTS

| | | | | | |
|---|---|---|---|---|---|
| 1,321,167 | A | * | 11/1919 | Voigt | 312/334.33 X |
| 3,524,691 | A | * | 8/1970 | Moore | 312/334.33 X |
| 4,030,609 | A | * | 6/1977 | Liebetrau et al. | 312/334.33 X |
| 4,482,066 | A | * | 11/1984 | Dykstra | 312/333 X |
| 5,902,029 | A | * | 5/1999 | Fulterer | 312/334.29 |
| 5,944,400 | A | * | 8/1999 | Fulterer | 312/334.29 X |
| 6,039,423 | A | * | 3/2000 | Fulterer | 312/334.29 |
| 6,199,966 | B1 | * | 3/2001 | Fulterer | 312/334.24 |

FOREIGN PATENT DOCUMENTS

| | | | |
|---|---|---|---|
| CH | 460709 | * | 10/1968 |
| DE | 3925815 | | 3/1990 |
| DE | 9526108 | | 6/1996 |
| DE | 19751163 | * | 6/1998 |
| DE | 19839728 | * | 3/1999 |
| DE | 19846778 | * | 4/1999 |
| FR | 2372608 | | 6/1978 |

* cited by examiner

*Primary Examiner*—Jose V. Chen
*Assistant Examiner*—Hanh V. Tran
(74) *Attorney, Agent, or Firm*—Sidley Austin Brown & Wood, LLP

(57) ABSTRACT

A pull-out device for a tall cupboard drawer including a stationary carcass rail fixedly securable to a carcass of the tall cupboard and provided with support rollers arranged in a region of the front end surface of the carcass rail, rotatably supported on inner sides of the side cheeks, and projecting upwardly past the side cheeks, an intermediate rail arranged within the carcass rail and provided with running rollers arranged in a region of its rear end surface, and a drawer-supporting member having a length of less than two-third of the length of the intermediate rail and provided with rear and front running rollers arranged, respectively, in rear and front regions of the drawer-supporting member.

8 Claims, 4 Drawing Sheets

H
L
B

PULL-OUT DEVICE FOR A TALL CUPBOARD DRAWER

BACKGROUND OF THE INVENTION

1. Field of the Invention

The present invention relates to a pull-out device for a drawer of a tall cupboard and including a stationary carcass rail fixed by securable to a carcass of the tall cupboard and having an upwardly opening, U-shaped cross-section with spaced from each other vertical side cheeks connected by a horizontal web and with the side cheeks being provided with inwardly extending horizontal flanges, respectively; support rollers provided in a region of the front end surface of the carcass rail, rotatably supported on inner sides of the side cheeks, and projecting upwardly past the side cheeks, the horizontal flanges each having, in a region of the support rollers, a recess; an intermediate rail arranged within the carcass rail and having an upwardly opening U-shaped cross-section with spaced from each other vertical side cheeks connected by a horizontal web and having projecting outwardly and inwardly, T-shaped horizontal flanges; running rollers provided in a region of a rear end surface of the intermediate rail, rotatably supported on outer sides of the side cheeks of the intermediate rail, and projecting downwardly, past the horizontal web of the intermediate rail; a member for rotatably supporting the drawer and displaceable relative to the intermediate rail, and having a bottom surface and spaced side surfaces connected by the bottom surface; and rear running rollers arranged in the rear region of the drawer, rotatably supported on outer sides of the side surface of the drawer-supporting member, and projecting past the bottom surface of the drawer-supporting member.

2. Description of the Prior Art

A pull-out device discussed above is disclosed, e.g., in Austrian Patent No. 406,006. In the Austrian Patent, the drawer-supporting member is formed as a profile rail. The profile rail has bent outwardly, horizontal flanges formed at the free ends of the profile rail cheeks and displaceable over the support rollers of the intermediate rail.

Also known are tall cupboards with drawers supported on a pull-out device with a possibility of rotation about a vertical axis. Such a drawer is usually so arranged that in a retracted condition, it has its longitudinal side extending parallel to the displacement direction of the pull-out device. On one or both longitudinal side(s) of the drawer, display items can be arranged. After being pulled out, the drawer is pivoted by 90° so that the display items are visible or accessible from the front side of the drawer.

The arrangement of a rotary support of a rotatable drawer on a pull-out device such as disclosed in Austrian Patent No. 406,006 is associated with a serious drawback. Namely, after the drawer has been pulled-out and pivoted by 90°, a front portion of the drawer-supporting profile rail projects forward, forming an obstacle. Therefore, it has been proposed to form a pull-out device for a pivotal drawer as a suspended guide. However, the formation of such a guide is associated with increased costs of not only the pull-out device but also of a tall cupboard itself as it has to support the increased weight of a loaded drawer.

In another known pull-out device for supporting a rotatable about vertical axis drawer, in the bottom of the device, there is provided a recessed rail on which a drawer-carrying rotary support is displaceably arranged. The pull-out device of this type is rather complicated and, in the course of time, the groove formed in the recessed rail becomes contaminated, in particular in its region located beyond the cupboard, which necessitates a rather expensive cleaning operation.

German Utility Model DE 93 16 213U1 discloses a book case with a pull-out and rotatable shelf section. The pull-out device, which is not described in many details, consists of three, arranged one above another pull-out parts. The length of the pull-out shelf section is not substantially larger than its width and, therefor, the formation of an obstacle by protection portion of a rail, upon pivoting of the shelf section, is not a problem in this book case.

In a case described in Swiss Patent CH 460 709, the pull-out section is rotatably supported in the region of a front end surface of a pull-out rail. The patent does not contain a detailed description of the pull-out device, but the drawings show that the pull-out device is formed as a very simple device, with the pull-out rail being somewhat shorter than the stationary rail. With this device, the depth of the case is not completely used, and the pull-out section is inclined backwards with respect to the vertical axis.

Accordingly, an object of the present invention is to provide a pull-out device for a drawer of a tall cupboard pivotable about a vertical axis with as complete as possible use of the cupboard depth.

Another object of the present invention is to provide a pull-out device for a drawer of a tall cupboard pivotable about a vertical axis, which would not contain any, projecting beyond the drawer, parts in the pull-out condition of the drawer.

SUMMARY OF THE INVENTION

These and other objects of the present invention, which will become apparent hereinafter, are achieved by providing a pull-out device in which the length of the displaceable, drawer-supporting member amounts to less than two/third (⅔) of the length of the intermediate rail, with the drawer or other displaceable cupboard element being rotatably supported on the displaceable member or on a rotary support secured on the displaceable drawer-supporting part, and which includes also front rollers provided in the region of the front end surface of the drawer-supported member and rotatably secured on outer sides of spaced side surfaces of the drawer supporting shaft, projecting downward beyond the bottom surface of the drawer supporting shaft.

Advantageously, the length of the drawer-supporting part amounts to about half of the length of the intermediate rail.

In advantageous embodiment of the present invention, the drawer-supporting part is formed as a profile rail having an upwardly opening, U-shaped cross-section, with the side surfaces forming the side cheeks and with the bottom surface forming the side cheek-connecting web. The profile rail is displaceable within the intermediate rail. The drawer-carrying rotary support can be secured on the profile rail.

The novel features of the present invention, which are considered as characteristic for the invention, are set forth in the appended claims. The invention itself, however, both as to its construction and its mode of operation, together with additional advantages and objects thereof, will be best understood from the following detail description of preferred embodiments, when read with reference to the accompanying drawings.

DETAILED DESCRIPTION OF THE PREFERRED EMBODIMENT

Figures 1, 2, 3, 4, 5, 6:
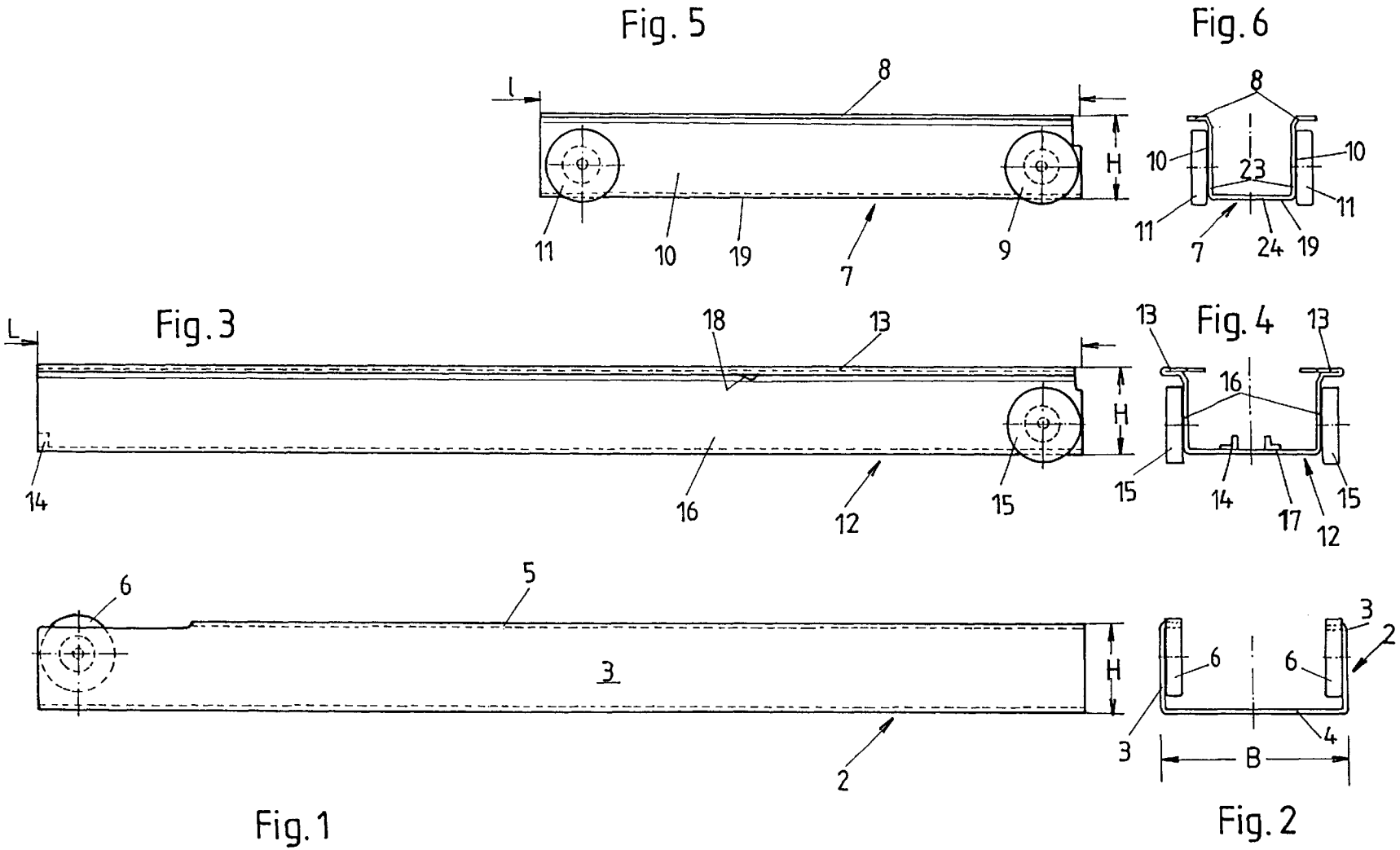
FIG. 1 a side view of a stationary carcass rail forming part of a pull-out device according to the present invention.
FIG. 2 end view of the rails shown in FIG. 1.
FIG. 3 a side view of an intermediate rail forming part of a pull-out device according to the present invention.
FIG. 4 end view of the rail shown in FIG. 3.
FIG. 5 a side view of a rail section formed as a profile rail and displaceable along the intermediate rail.
FIG. 6 end view of the rail shown in FIG. 5.
Figure 8:
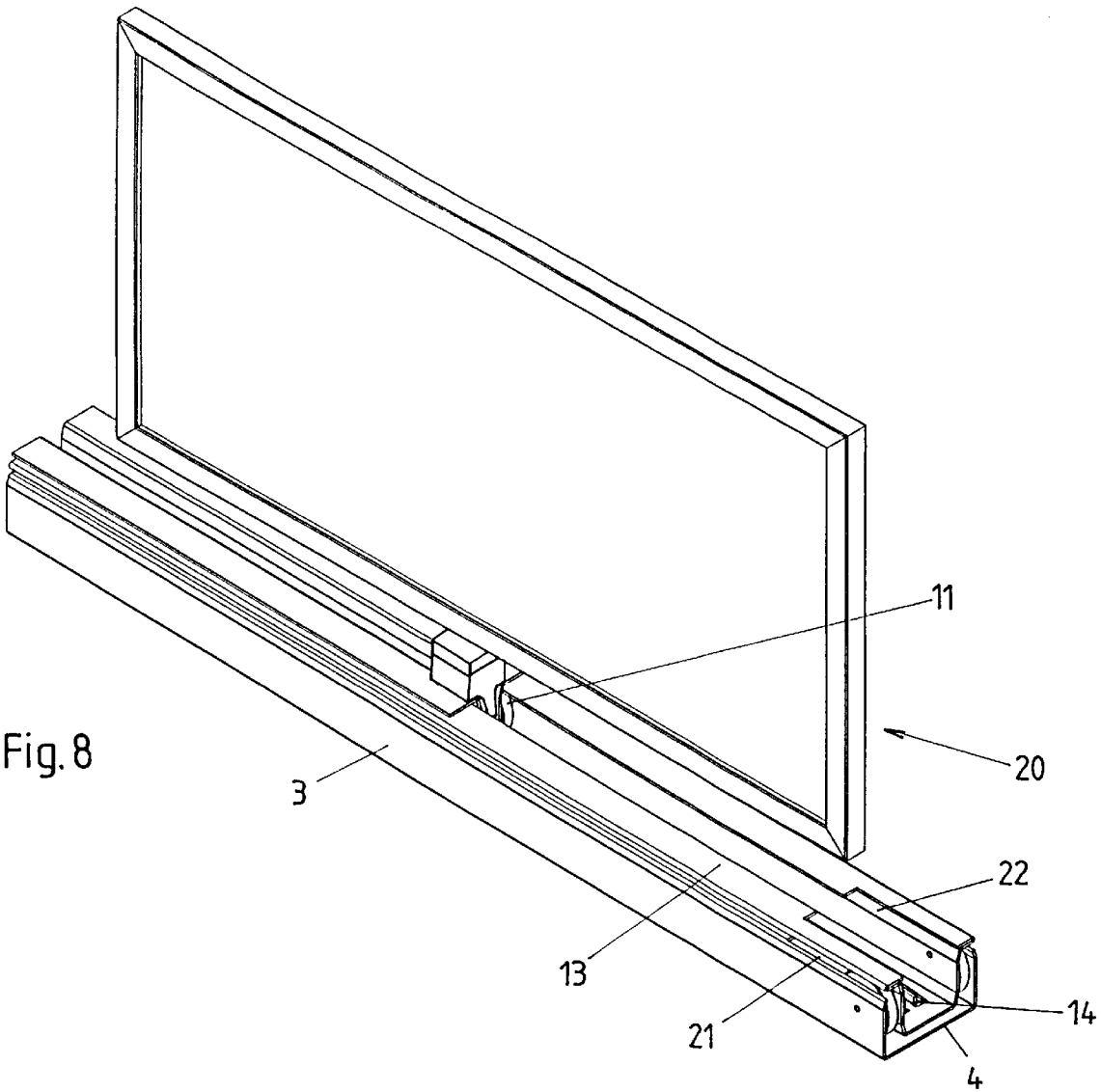
FIG. 8 a perspective view of the rail assembly of a pull-out device according to the present invention with a schematically shown rotary support in a retracted position of the pull-out device.

A carcass rail 2 of pull-out device according to the present invention is fixedly secured to the furniture body and has a U-shaped cross-section with two vertical side cheeks 3 and a horizontally extending web 4 connecting the side cheeks 3. The upper edges of the side cheeks 3 are bent inward toward a center plane of the carcass rail 2, forming horizontal flanges 5. At the front end of the carcass rail 2, the horizontal flanges 5 have each a recess 21 (FIG. 8). At the front end region of the carcass rail 2, these are provided freely rotatable support rollers 6 secured on the inner sides of the cheeks 3. The support rollers 6 project upward past the horizontal flanges 5. The support rollers 6 extend perpendicular to the plane of FIG. 1 one next to the other (FIG. 2).

An intermediate rail 12 of the pull-out device likewise has a U-shaped cross-section with vertical side cheeks 16 connected by a horizontal web 17. At the upper edges of the side cheeks 16, there are provided T-shaped flanges, 13 extending both outward and inward toward a central plane of the intermediate rail 12. In the rear region of the intermediate rail 12, there are provided freely rotatable running rollers 15 secured on the outer sides of the cheeks 16. The running rollers 15 extend downwardly past the connecting web 17 of the intermediate rail 12, as shown in FIG. 4. Downwardly projecting, dent-like, bent-out elements 18 are provided, respectively, on the outwardly directed sections of the T-shaped horizontal flanges 13. The elements 18 serve as stops, limiting the pull-out displacement of a drawer. At the front end, the inwardly directed sections of the T-shaped horizontal flanges 13 are provided with recesses 22 (FIG. 8), respectively.

The drawer-supporting member can be formed, e.g., as a profile rail 7 displaceable relative to the intermediate rail 12 and also having a U-shaped cross-section with side cheeks 23 and connecting web 24 which extends horizontally and connects the cheeks 23. The inner surface of the rail 7 forms a bottom 19 of the displaceable element of the cupboard. Rear running rollers 9 are provided at the rear side of the profile rail 7 and project downward past the horizontal web 24. In the region of the front end of the shaped rail 7, there are provided freely rotatable running rollers 11 secured on the outer surfaces 10 of the side cheeks 23. The front running rollers 11 likewise project downwardly past the horizontal connecting web 24.

A stop 14 is provided in the region of the front end of the intermediate rail 12. The stop 14 is provided on the horizontal web 17.

Figure 7:
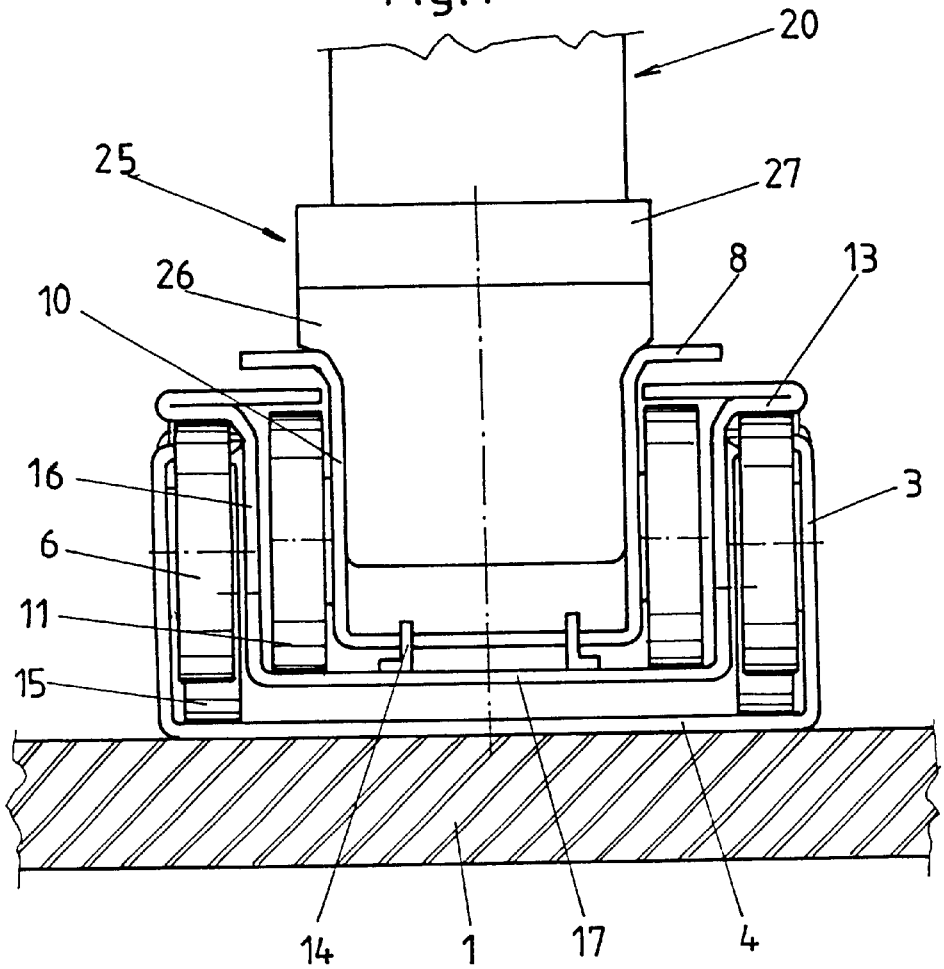
FIG. 7 an end view of the rail assembly of a pull-out device according to the present invention with a schematically shown rotary support in a retracted position of the pull-out device.
Figure 9:
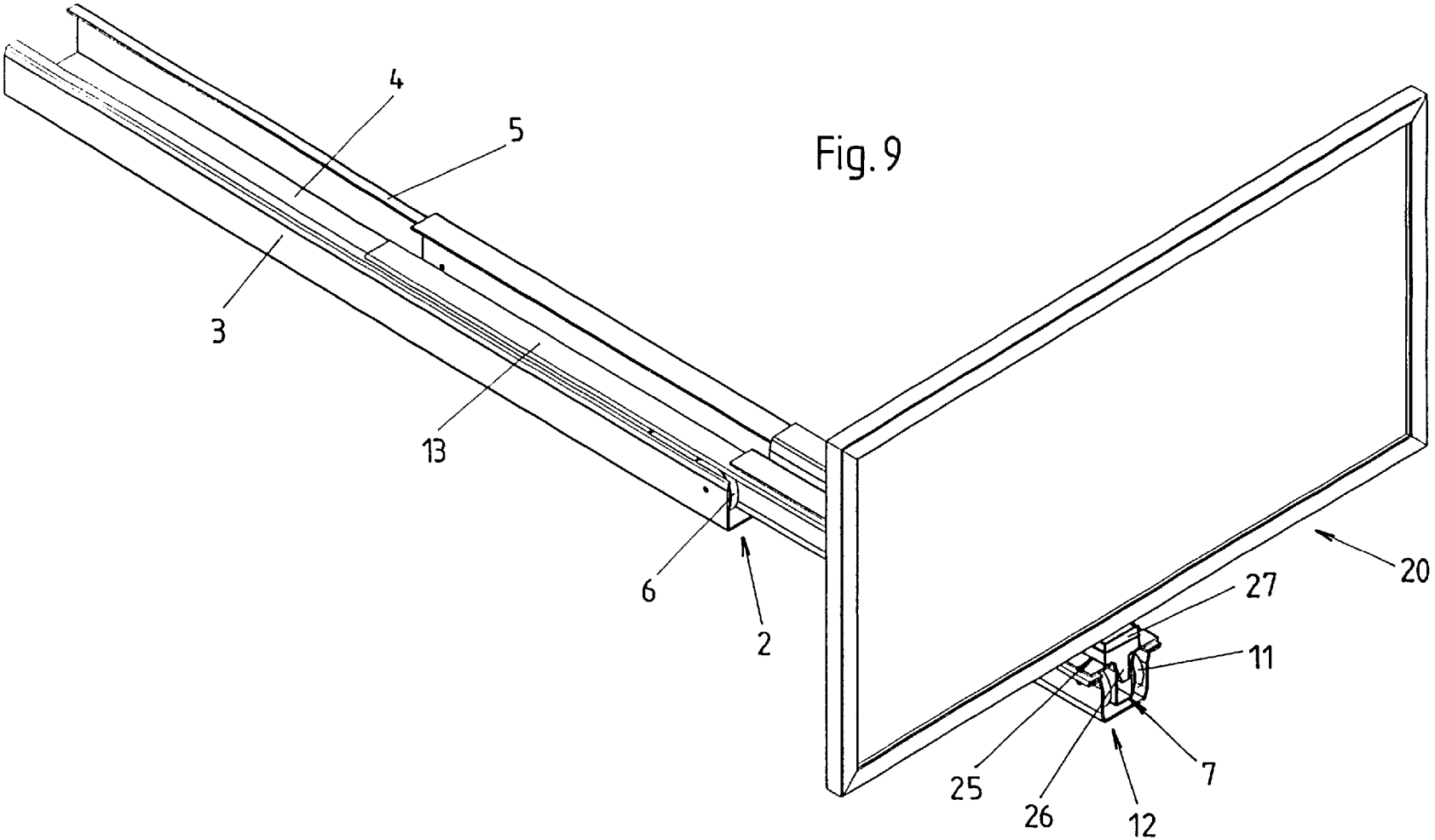
FIG. 9 a view of the rail assembly shown in FIG. 8 but in a pull-out and pivotable position of the pull-out device.

All three of the rails 2, 12, and 7 have approximately the same height H. The diameter of the running and support rollers 6, 9, 11, and 15 can also be the same. However, the widths of the rails 2, 12, and 7 are different and are so selected that the rails 2, 12, and 7 are arranged one within the other, as shown in FIGS. 7–9, with the open sides of the rails 2, 12, 7 facing upward and with the horizontal webs 4, 17, 24 of the rails 2, 12, 7 closely adjacent overlying each other with a small vertical clearance therebetween. The vertical clearance between the adjacent horizontal webs 4, 17 and 17, 24 is substantially the same and is relatively small in comparison with the height H of the rails 2, 12, and 7 and is equal approximately to two/tenth of the height. The recesses 21 and 22 serve for connecting the rails 2, 12, and 7 with each other.

The length of the displaceable profile rail 7 is equal to about half of the length of the intermediate rail 12. For pivotally supporting a drawer 20 of a tall cupboard (the pull-out part of the tall cupboard) of which only a frame is shown in FIGS. 8–9, a rotary support 25 is provided in the region of the front end surface of the profile rail 7 in its open profile. The rotary support 25 includes a base member 26 connectable with the displaceable profile rail 7, and a rotatable member 27 displaceable relative to the base member 26. The frame of the drawer 20 is secured on the rotatable member 27. For connecting the rotatable member 27 with the base member 26, a thrust or slide bearing can be provided. The rotary support 25 can be so formed that it would provide for retaining the drawer 20 in two, pivotal by 180° relative to each other, positions in which the frame extend parallel to rails 2, 12, and 7 as shown in FIG. 8.

In the retracted condition of the drawer 20, the rear end of the displaceable profile rail 7 approximately coincides with rear ends of the intermediate rail 12, and the carcass rail 2. To this end, there can be provided, in a conventional manner, appropriate stops (not shown). The longitudinal sides of the drawer 20 lie parallel to the rails 2, 12, and 7. Therefore, the length of the drawer 20 can correspond essentially to the length of the pull-out device (and, thus, can correspond to the depth of the tall cupboard itself, not shown). Upon the drawer 20 being pulled-out, the rail 7 is displaced relative to the intermediate rail until it abuts the stop 14 on the intermediate rail 12. Then, the intermediate rail 12, together with the profile rail 7 and the drawer 20 supported on the rail 7 is pulled-out from the stationary carcass rail 2, until it abuts the dent-shaped stop 18. In this position of the rails 2, 12,7, the rear end of the drawer 20 is located in front of the front end of the carcass rail 2 and, thus, in front of the furniture body 1. In this position, the drawer 20 can be pivoted by 90° into a position shown in FIG. 9.

Figure 10:
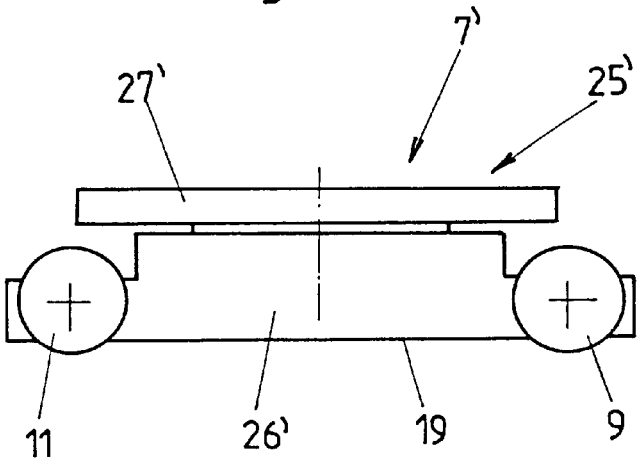
FIG. 10 a side view of the rotary support.
Figure 11:
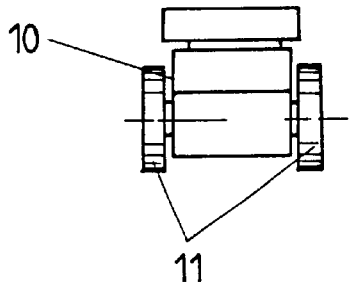
FIG. 11 an end view of the rotary support.

Instead of the profile rail 7, the drawer supporting member $7^1$, can be formed as schematically shown in FIGS. 10–11. In the embodiment shown in FIGS. 10–11, the base member $26^1$ is formed as a running carriage provided with front and rear, freely rotatable running rollers 9, 11 arranged on side surfaces 10 of the base member $26^1$ and extending downwardly past the bottom surface 19 of the base member $26^1$. A plate-shaped member $27^1$ is rotatably supported on the base member $26^1$. The height of the base member $26^1$ somewhat corresponds to the height H of the intermediate rail 12, so that the rotatable member $27^1$ is arranged above the T-shaped horizontal flanges 13 of the intermediate rail 12. The drawer 20, as it has already been discussed above, is supported on the rotatable member $27^1$. The length of the drawer-supporting member $7^1$ is noticeably shorter than a half-length of the intermediate rail 12, so that in the retracted position, the drawer-supporting member $7^1$ is not displaced up to the rear end of the intermediate rail 12 when the drawer has a length of the intermediate rail 12. To limit the backward displacement of the member $7^1$ toward the rear end of the intermediate rail 12, there is provided, on the intermediate rail 15, an appropriate stop.

In principal, it is possible to arranged further intermediate rails between the carcass rail 2 and the intermediate rail 12, which could be provided at their rear ends with running rollers (as the intermediate rail 12) and, at their front end, with support rollers projecting upward past the T-shaped flanges, respectively (similar to the rollers 6 of the carcass rail 2). The length of the displaceable drawer-supporting member need be shorter than two/third of the intermediate rail 12, which would permit to use a drawer with a length substantially corresponding to the depth of the tall cupboard, without a stumbling rails portion extending into an empty space in the pull-out and pivotal position of the drawer.

Accordingly, though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments within the spirit and scope of the present invention as defined by the appended claims.

What is claimed is:

1. A pull-out device for a drawer of a tall cupboard, comprising:

a stationary carcass rail fixedly securable to a carcass of the tall cupboard and having an upwardly opening, U-shaped cross-section with spaced from each other vertical side cheeks connected by a horizontal web and with the side cheeks being provided with inwardly extending horizontal flanges; respectively;

support rollers provided in a region of the front end surface of the carcass rail, rotatably supported on inner sides of the side cheeks and projecting upwardly past the side cheeks, the horizontal flanges each having, in a region of the support rollers, a recess;

an intermediate rail arranged within the carcass rail and having an upwardly opening U-shaped cross-section with spaced from each other vertical side cheeks connected by a horizontal web and having projecting outwardly and inwardly, T-shaped horizontal flanges;

running rollers provided in a region of a rear end surface of the intermediate rail, rotatably supported on outer sides of the side cheeks of the intermediate rail, and projecting downwardly past the horizontal web of the intermediate rail;

a member for rotatably supporting the drawer and displaceable relative to the intermediate rail, and having a bottom surface and spaced side surfaces connected by the bottom surface, the drawer-supporting member having a length amounting to less than two/third (⅔) of a length of the intermediate rail; and rear and front running rollers arranged, respectively, in rear and front regions of the drawer supporting member, rotatably supported on outer sides of the side surfaces of the drawer-supporting member, and projecting past the bottom surface of the drawer-supporting member.

2. A pull-out device as set forth in claim 1, further comprising a rotary support secured on the drawer-supporting member for rotatably supporting the drawer.

3. A pull-out device according to claim 1, wherein the length of the drawer-supporting member amounts to approximately a half of the length of the intermediate rail.

4. A pull-out device as set forth in claim 1, wherein the drawer-supporting member is formed as a profile rail having an upwardly opening, U-shaped cross-section, with the side surfaces forming the side cheeks and the bottom surface forming a web connecting the side cheeks.

5. A pull-out device as set forth in claim 1, wherein the drawer-supporting member is formed by a base member of a rotary support and on which the rear and front rollers are rotatably supported, and wherein the rotary support has a rotatable member rotatably supported on the base member for supporting the drawer.

6. A pull-out device as set forth in claim 1, further comprising a stop for the displaceable drawer-supporting member and provided in the region of the front end surface of the intermediate rail.

7. A pull-out device as set forth in claim 6, wherein inwardly projecting sections of the T-shaped flanges of the intermediate rail have, in the region of the front end surface of the intermediate rail, recesses which provide for insertion of the displaceable drawer-supporting member into the U-shaped cross-section of the intermediate rail.

8. A pull-out device as set forth in claim 1, wherein a rotational axis of the drawer extends substantially vertically.

* * * * *